US005896082A

United States Patent [19]

MacFarlane

[11] Patent Number: 5,896,082

[45] Date of Patent: Apr. 20, 1999

[54] FIRE DETECTION SYSTEM

[75] Inventor: Robert Kenneth MacFarlane, Western Cape, South Africa

[73] Assignee: Ziton SA (Proprietary) Limited, South Africa

[ * ] Notice: This patent issued on a continued prosecution application filed under 37 CFR 1.53(d), and is subject to the twenty year patent term provisions of 35 U.S.C. 154(a)(2).

[21] Appl. No.: 08/697,064

[22] Filed: Aug. 19, 1996

[30] Foreign Application Priority Data

Aug. 18, 1995 [ZA] South Africa ..... 95/6920

[51] Int. Cl.[6] ..... G08B 1/00

[52] U.S. Cl. ..... 340/286.05; 340/507; 340/518; 340/521; 340/577

[58] Field of Search ..... 340/286.05, 628, 340/521, 517, 518, 522, 588, 589, 511, 507, 584, 577

[56] References Cited

U.S. PATENT DOCUMENTS

| | | | |
|---|---|---|---|
| 4,525,700 | 6/1985 | Kimura et al. | 364/550 |
| 4,746,910 | 5/1988 | Pfister et al. | 340/567 |
| 4,796,205 | 1/1989 | Ishii et al. | 340/518 |
| 4,812,819 | 3/1989 | Corsberg | 340/517 |
| 4,975,684 | 12/1990 | Guttinger et al. | 340/522 |
| 5,260,687 | 11/1993 | Yamauchi et al. | 340/522 |
| 5,483,222 | 1/1996 | Tice | 340/518 |
| 5,557,262 | 9/1996 | Tice | 340/522 |
| 5,565,852 | 10/1996 | Peltier et al. | 340/517 |

FOREIGN PATENT DOCUMENTS

| | | |
|---|---|---|
| 0137708 | 4/1985 | European Pat. Off. . |
| 0367486 | 5/1990 | European Pat. Off. . |
| 0729125 | 8/1996 | European Pat. Off. . |
| 2741767 | 5/1978 | Germany . |
| 146868 | 3/1981 | Germany . |
| 2012092 | 7/1979 | United Kingdom . |
| 2161966 | 1/1986 | United Kingdom . |
| 2252191 | 7/1992 | United Kingdom . |

*Primary Examiner*—Jeffery A. Hofsass
*Assistant Examiner*—Davetta Woods
*Attorney, Agent, or Firm*—Baker & Botts, L.L.P.

[57] ABSTRACT

An intelligent fire detection system is disclosed which includes a control panel and a plurality of detectors distributed throughout the building being protected. The software of the panel treats the detectors as being in one or more groups. All the detectors in a group can be in the same room. The detectors are set so as to be sensitive to small concentrations of smoke eg 0.3% per meter obscuration. Only if all the detectors in a group, or a predetermined lesser number of the detectors in a group, have smoke concentrations at or above the threshold level does the panel establish an alarm condition. The panel can also establish an alarm condition when the presence in any single detector of smoke at a higher concentration eg 3% per meter obscuration is detected. The system can alternatively include detectors sensitive to other emissions from a fire eg heat, ionized particles or carbon monoxide.

5 Claims, 2 Drawing Sheets

FIRE DETECTION SYSTEM

FIELD OF THE INVENTION

This invention relates to a fire detection system.

BACKGROUND TO THE INVENTION

It is conventional practice to build a fire detection system into a building. Such systems usually include a control panel and detectors which are distributed throughout the building. Each detector is linked to the panel. The detectors are of various types such as smoke detectors, heat detectors, ionization detectors etc.

Smoke detectors take a number of forms. For example, an extensively used form of smoke detector comprises a light source and a light sensitive cell. The light source and the cell are misaligned in the sense that light from the light source cannot fall directly on the cell. For light to reach the cell, it must be reflected off particles in the air. As the quantity of smoke in the air increases, more light is reflected onto the cell with the result that the output of the cell increases. The panel is set to establish an alarm condition when the output of the cell reaches a predetermined value. For example, the panel can be set to establish an alarm condition when the quantity of smoke in the air reaches 3% per meter obscuration.

Fire detection systems are also known which include so-called aspirating high sensitivity smoke detectors. The smoke detector itself is mounted within a closed box and one or more pipes run from the box through the areas being protected. Each pipe has a plurality of holes in it. A fan evacuates the box so that air is drawn into the box through the pipes. The smoke detector is set so as to be far more sensitive than smoke detectors which are distributed throughout the building. Typically, high sensitivity smoke detectors are set to give an alarm condition when the smoke percentage reaches 0.1% per meter obscuration.

It will be appreciated that air is entering the pipes through a plurality of holes and that the pipe may run through a number of separate rooms. Should there be a fire in one of the rooms, then smoke will be drawn into the pipe through the holes which are in that room. However, uncontaminated air will be drawn into the pipe through holes which are in the other rooms. There is thus, in the pipe, a diluting effect. More specifically, the smoke which enters the pipe from the room in which there is a fire is mixed with clean air coming in from the other rooms. Thus, while the high sensitivity detector may be set to establish an alarm condition at 0.1% per meter obscuration in the detector box, there must be far more smoke in the burning room than that before the smoke percentage at the high sensitivity detector itself reaches 0.1% per meter obscuration.

Generally fire detection systems have to be made insensitive to low emission levels (whether it be smoke, ionized particles or heat) to prevent so-called nuisance alarms. The more sensitive the system is to low emission levels the more prone it is to establishing an alarm condition when there is no fire.

OBJECT OF THE PRESENT INVENTION

The object of the present invention is to provide a fire detection system which establishes an alarm condition when subjected to a low level of emission from a fire but which is not prone to nuisance alarms due to its sensitivity.

BRIEF SUMMARY OF THE INVENTION

According to the present invention there is provided a fire detection system comprising a control panel, a group of detectors for sensing emissions from a fire, means for connecting the detectors to the control panel so that the status of each detector is communicated to the control panel, first means for establishing an alarm condition upon any detector sensing the presence of emissions at or above a predetermined upper level, and second means for establishing an alarm condition when at least two detectors in the group simultaneously sense the presence of emissions at or above a lower predetermined level.

It is possible for the second means to be such that all the detectors in the group must simultaneously detect the presence of emissions at or above said predetermined lower level before an alarm condition is established. However, it is preferably that the second means be such at a predetermined minimum number of detectors in the group, which minimum number is less than the number of detectors in the group, must simultaneously detect the presence of emissions at or above said predetermined lower level before an alarm condition is established.

It is also desirable to arrange the detectors in a plurality of groups of detectors and to provide third means for comparing the output signals from detectors of one group that are sensing emissions above said predetermined lower level with the output of detectors of at least one other group.

BRIEF DESCRIPTION OF THE DRAWING

For a better understanding of the present invention, and to show how the same may be carried into effect, reference will now be made, by way of example, to the accompanying drawings in which.

DETAILED DESCRIPTION OF THE DRAWING

Figure 1:
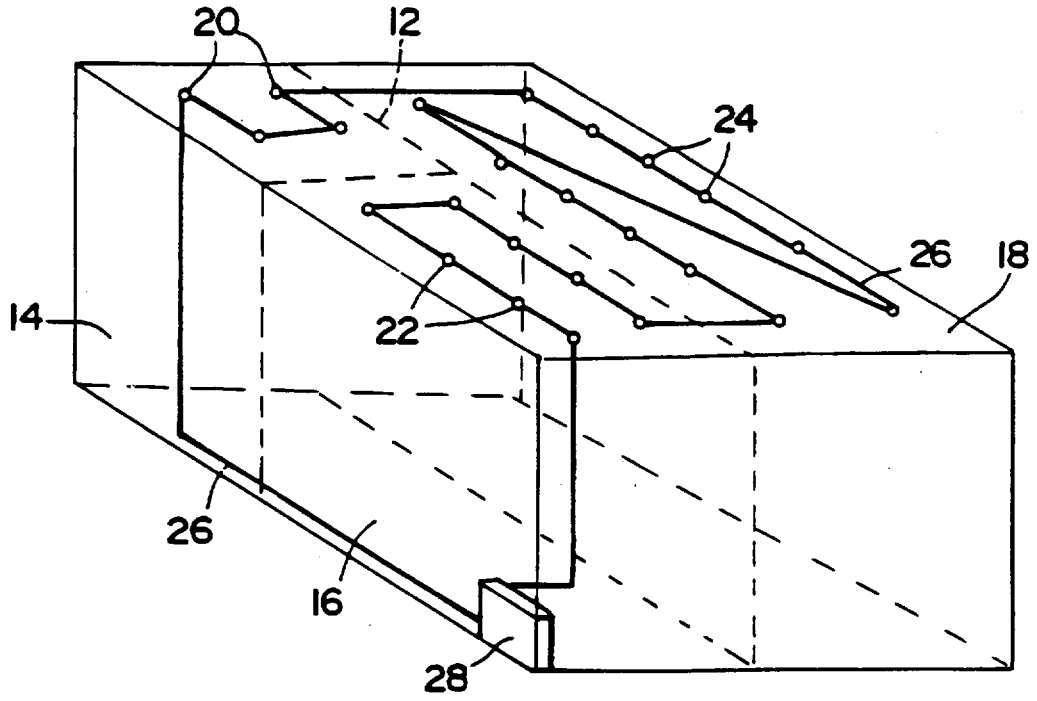
FIG. 1 is a diagrammatic representation of a fire detection system in accordance with the present invention.

In FIG. 1 reference numeral 10 indicates a single story building protected by a fire detection system. The building is divided by internal walls 12 into three rooms designated 14, 16 and 18. Mounted on the ceilings of the rooms are pluralities of fire detectors 20, 22 and 24. For the purposes of the present description it will be assumed that the detectors are all smoke detectors. Reference numeral 26 designates an electrical line which extends in a loop from a control panel 28 to the detectors 20, 22, 24.

The panel 28 is of the so-called intelligent type which interrogates each of the detectors 20, 22, 24 in turn. At each interrogation the detector is caused to send to the panel signals which inter alia are indicative of the amount of smoke inside the detector. In a conventional system the output of each detector is treated entirely independently of the output of each other detector. More specifically, if the output from any detector indicates a smoke content of above a predetermined level (say 3% per meter obscuration) then the panel 28 will indicate an alarm condition. This is achieved by means of the software of the panel. This predetermined level is an upper level.

In accordance with the present invention the software of the panel is set to react to a smoke content in any detector at another level which is below the predetermined upper level. This predetermined lower level can be, for example, at 0.3% per meter obscuration. This means that each detector is functioning both as a standard sensitivity detector and as a high sensitivity detector. However, a detector set to this level is over-sensitive and relatively small amounts of dust or cigarette smoke in the atmosphere will result in a smoke percentage of more than 0.3% per meter obscuration and hence establish an alarm condition. To prevent false or nuisance alarms of this nature the smoke detectors are, in accordance with the present invention, treated by the panel as being in groups. Thus, the detectors 20 are treated as a first group, the detectors 22 are treated as a second group and the detectors 24 as a third group.

The panel software does not establish an alarm condition should the number of detectors in a group which are simultaneously sensing quantities of smoke above the lower predetermined level be below a predetermined number. For example, in the illustrated embodiment, the software of the panel can be such that it will only establish an alarm condition if all four of the detectors 20 are simultaneously reading above 0.3% per meter obscuration smoke content. If all the detectors in a room are detecting smoke at that level, then it is a reasonable assumption that there is a fire which is providing the smoke content.

Should the room being protected be large, and have a substantial number of smoke detectors in it, then the software of the panel can be such that a minimum number of the detectors in the room must simultaneously contain smoke above the lower predetermined level before an alarm condition is established. Simply by way of example, there twelve detectors 24 in the largest room 18 shown. The panel can be programmed so that only when, say, five detectors indicate the presence of smoke above the lower predetermined level does the panel establish an alarm condition.

The illustrated system enables an alarm condition to be established when the smoke percentage in a room or other space being protected exceeds a lower predetermined value. Because the detectors are grouped in the way described, and an alarm condition is only established when a minimum number of detectors are simultaneously recording smoke percentages above the lower predetermined level, false alarms resulting from a small amount of smoke or dust in part of the room can be avoided.

It will be appreciated that the software establishes an alarm condition immediately that any detector records a smoke percentage above the higher predetermined level eg 3% per meter obscuration. Thus the system has all the advantages of standard sensitivity systems and will establish an alarm condition when a single detector has a substantial amount of smoke in it, whilst also being able to record low smoke percentages without giving false alarms.

Figure 2:
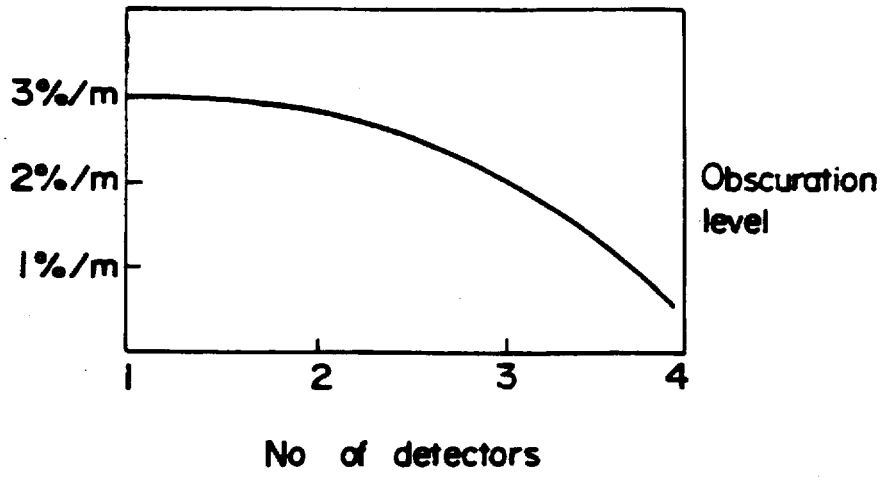
FIG. 2 is a graph illustrating sensitivity.

The actual smoke percentage that is used to cause an alarm condition to be established can vary with the number of detectors in the group. The more detectors that must have reached the lower predetermined level before an alarm condition is established, the lower the percentage obscuration per meter that can be used as a threshold. In this regard reference is made to FIG. 2. As illustrated, one detector must reach 3% per meter obscuration before an alarm condition is established. Two detectors in a group would have to reach close to 2% per meter obscuration before it was safe to assume that there was an alarm condition. A multiplicity of detectors would only need to reach 0.3% per meter obscuration each to make it safe to establish an alarm condition. Thus thresholds of between 0.3% and 3% per meter obscuration would be used.

As a further precaution against false alarms, a reading from a group of detectors indicating that all, or the predetermined number of them, have simultaneously reached the predetermined lower level can be checked by comparing the readings from the detectors in other groups of detectors on the line 26. If all the groups are giving readings that exceed the predetermined lower level, then it can be assumed that it is more likely to be a so-called nuisance alarm caused by a power surge, atmospheric conditions etc than it is to be excessive smoke levels.

Figure 3:
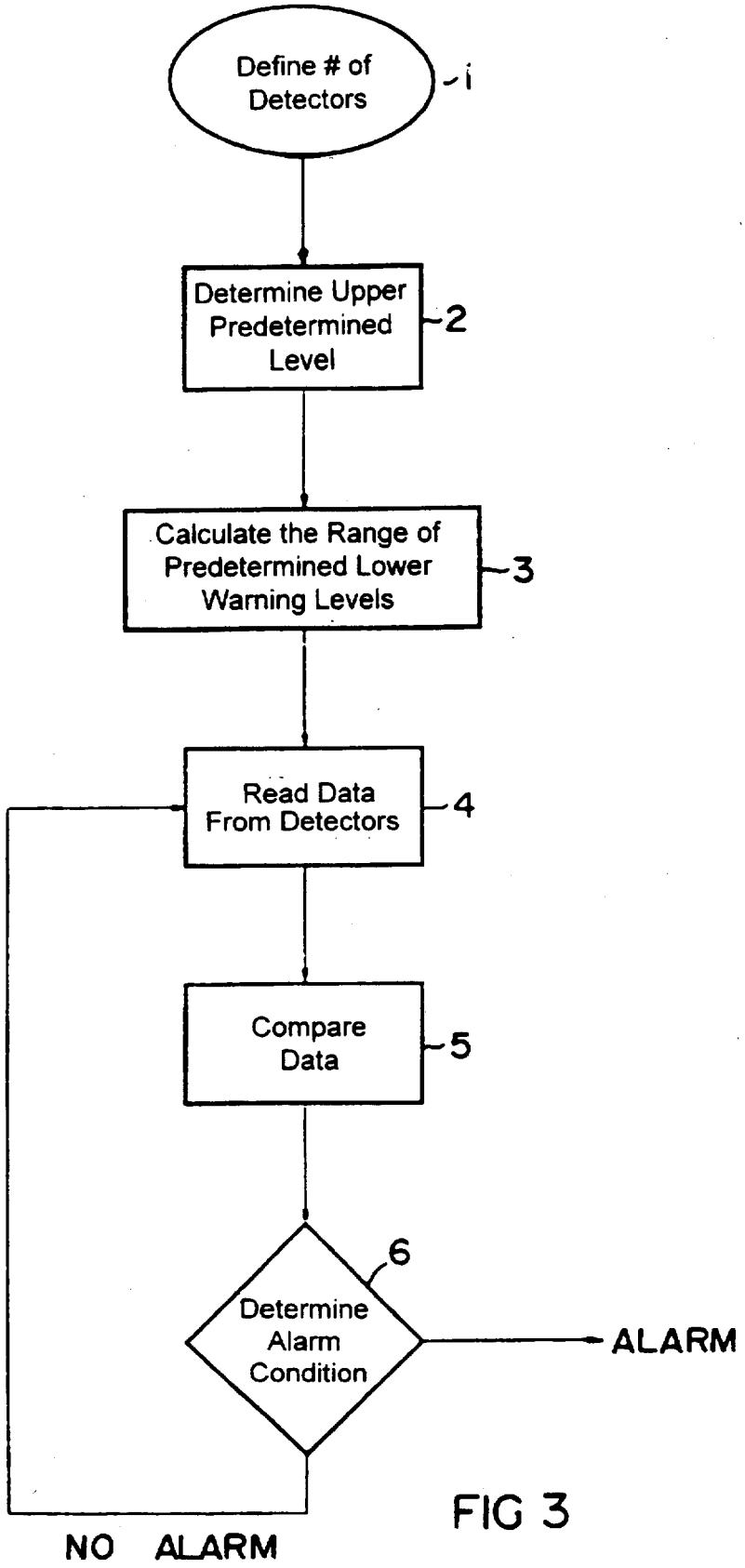
FIG. 3 is a block diagram of the system.

FIG. 3 is a flow chart showing how the system is set up and operates.

The first step, block 1, is to define the number of groups of detectors into which the total number of detectors in the building will be divided, and then to define the number of sensors in each of the groups. This information is stored in memory. Block 2 represents a decision, then stored into memory, as to what the upper predetermined level will be. Block 3 represents the mathematical calculation of a range of predetermined lower warning levels. These levels depend on whether the number of detectors that must register the lower level is 2, 3, 4 etc up to all the detectors in the group. This information is stored in memory.

In use, Block 4, data is read from all the detectors in a group and compared in Block 5 with the information stored in memory (Blocks 1 to 3). At Block 6 whether or not to establish an alarm condition is determined. If no alarm condition is established then the feedback loop ensures that the reading and comparison procedure continues.

An advantage of the present invention over the aspirating system is that smoke detection takes place in the room being protected and not at a remote location. Consequently, the presence of smoke is detected almost instantaneously. In an aspirating smoke detector it can take up to one minute for smoke contaminated air to reach the closed box within which detection takes place.

In the illustrated embodiment a line 26 connects the detectors to the panel. However, the line 26 could be replaced by radio links between the detectors and the panel. Where necessary, because, for example, the building structure blocks the radio signals to and from a particular detector, repeater stations can be used.

The smoke detectors can be replaced by any other form of detector which is sensitive to emissions from a fire. For example, detectors for ionized articles, heat detectors or detectors sensitive to carbon monoxide can be used in place of smoke detectors.

In the described embodiment it is the panel which initiates communication between the panel and the detectors. However, it is possible for the detectors to have some intelligence and include means which enables them to initiate communication with the panel and with other detectors. The type of system where the detectors have some intelligence is becoming known as a distributed processing system. In the form of the present invention using distributed processing, the detectors in a group first communicate their statuses to one another. Only when the emission level in the predetermined number of detectors in the group is above the lower predetermined level do the detectors communicate their statuses to the panel and establish an alarm condition.

I claim:

1. A fire detection system comprising a control panel, a group of detectors, each detector in the group sensing the same type of emission from a fire as each other sensor in the group, means for connecting the detectors to the control panel so that the statuses of the detectors are communicated to the control panel, first means for establishing an alarm condition upon any one of the detectors of the group sensing the presence of said emission at or above a predetermined upper level, and second means for establishing an alarm condition on when at least two detectors in the group simultaneously detect the presence of said same type of emission at or above a predetermined lower level.

2. A fire detection system according to claim 1, in which said second means is such that all the detectors in the group must simultaneously detect the presence of said emission at or above said predetermined lower level before an alarm condition is established.

3. A fire detection system according to claim 1, in which said second means is such that a predetermined minimum number of detectors in the group, which minimum number is less than the number of detectors in the group, must simultaneously detect the presence of said emission at or above said predetermined lower level before an alarm condition is established.

4. A fire detection system according to claim 1, in which the detectors are in a plurality of groups of detectors and third means are provided for comparing the output signals from detectors of one group that are sensing said emission above said predetermined lower level with the output of detectors of at least one other group.

5. A fire detection system according to claim 1, in which the detectors in a group communicate their statuses to one another and only communicate their statuses to the panel when at least two detectors in the group simultaneously detect the presence of said emission at or above said predetermined lower level.

* * * * *